United States Patent [19]

McMullen et al.

[11] 4,156,325

[45] May 29, 1979

[54] SILL KIT OR ASSEMBLY

[76] Inventors: Gerald W. McMullen, P.O. Box 176, Sackville, New Brunswick E0A 3C0; Harold H. Upham, 75 Vail St., Apt. 9, Moncton, New Brunswick E1A 3L2; Edgar I. Edgett, 81 Queensway Dr., Moncton, New Brunswick E1C 8K2, all of Canada

[21] Appl. No.: 858,020

[22] Filed: Dec. 6, 1977

[30] Foreign Application Priority Data

Oct. 21, 1977 [CA] Canada ..... 289235

[51] Int. Cl.[2] ..... E06B 1/70

[52] U.S. Cl. ..... 49/468

[58] Field of Search ..... 49/468, 467, 469

[56] References Cited

U.S. PATENT DOCUMENTS

| | | | |
|---|---|---|---|
| 1,178,859 | 4/1916 | Krause | 49/468 |
| 1,595,827 | 8/1926 | Frisque | 49/468 |
| 3,900,967 | 8/1975 | Bursk et al. | 49/468 |
| 4,003,162 | 1/1971 | Britt | 49/469 X |

*Primary Examiner*—Philip C. Kannan

*Attorney, Agent, or Firm*—Spencer & Kaye

[57] ABSTRACT

A sill assembly for covering the bottom frame of a door, a window or the like, of the adjustment-wedge type, wherein a wedge is operated from the interior of the door frame to align the crown of the sill with the bottom wedge of the door. The invention advances the art by providing extrusion molded members whose shape and disposition combines light weight and rigidity of the assembly, by utilizing the entire length of the sill for the wedging action and also by providing the sill crown of the type of an integral molded member including a reinforcing portion of a generally tubular cross-section which also forms one of the two wedging members.

10 Claims, 4 Drawing Figures

SILL KIT OR ASSEMBLY

The present invention relates to a sill kit or assembly forming the external surface of a bottom frame of an opening such as door or window opening, into which a closure member, such as a door or a window is to be set. The present invention is particularly concerned with but not necessarily limited to the art of door thresholds.

The attractiveness in appearance, relatively low cost of manufacture, good workability and many other features of threshold assemblies of extrusion molded components have made same extremely popular, particular due to the fact that extruded components of such assemblies are relatively inexpensive.

Threshold assemblies of the above type have long been known. Reference may be had in this context to Canadian Pat. No. 924,964, issued to John J. Kempel on Apr. 24, 1973, and also to U.S. Pat. No. 2,893,069 issued to W. P. Kessler on July 7, 1959, even though the latter reference relates to a shower bath frame levelling device rather than to a threshold.

Kempel indicates and describes the need for a threshold to possess the feature of adjustablility of the sill crown in vertical direction in order to bring same into alignment with the associated door or other closure member. It shows one way of providing the threshold assembly with such adjustablility, namely a plurality of six screws whose height is adjustable by turning the respective screw, the heads of the said screws supporting the associated crown of the sill at points spaced from each other along the crown. The disadvantage of this arrangement is that the alignment of the crown with the associated bottom edge of the door must be done by the trial-end-error method due to the fact that the access to the adjustment screws requires that the door be opened. Accordingly, a worker adjusting the level of the sill crown must open the door, then adjust the level, close the door again and check the gap between the bottom edge of the door and the sill crown to see whether further adjustments are necessary.

Thus, the drawback of this arrangement is in a relatively lengthy and inconvenient way of adjustment which often results in an inappropriate arrangement of the cooperating parts of the door and of the sill. Even more important, the strength of the sill crown supported by a plurality of adjustment screws, normally engaged by their threaded portions in an extruded aluminum base, is very low as the thread joint of the adjustment screw is the only portion of the overall assembly carrying the load to which the crown is normally exposed.

The above U.S. patent to Kessler appears to present an advantage over Kempel in that it utilizes a wedge principle for adjustment of the level of the upper portion of a shower bath frame. Two blocks horizontally spaced apart are being used, the blocks engaging a wedge surface provided in the extrusion molded frame member of the curtain. This arrangement, if used in door sills, would eliminate the first disadvantage referred to in connection with the Kempel patent. However, due to the relatively short wedging blocks, the overall assembly would not be rigid enough for use in art such as door sills as door sills are frequently exposed to an extreme load, unless the components are made from a strong and thus expensive material such as steel or the like.

It is an object of the present invention to overcome the above drawbacks of prior art and to provide a new and useful sill assembly that would combine the advantages of low cost of extrusion molded aluminum and plastic members, with a high rigidity of the sill crown combined with an improved stability of the overall sill following the appropriate adjustment.

According to the present invention, a sill assembly or kit is provided for forming the external surface of bottom frame of an opening into which a closure member is to be set. The kit or assembly is of the type including an elongated sill crown whose top surface is arranged to define a top surface portion of the sill. The arrangement includes adjustment means for selectively adjusting the level of the top surface portion to bring same into a generally parallel relationship with the bottom edge of an associated closure member such as a door or the like. The adjustment means is of the type of wedge means comprising a first wedge member and a second wedge member, the wedge members being adapted to engage each other along a generally planar surface generally parallel with the elongation of the sill crown and, on application, sloping downwardly and outwardly relative to said opening; said adjustment means further comprising displacement means for selectively displacing said first wedge member in a generally horizontal direction to adjust the level of said top surface portion of the crown. Retainer means arranged to prevent displacement of the second wedge member in the direction of displacement of said first wedge member forms a further part of the arrangement of the present invention. The surfaces of the first wedge member and of the second wedge member are arranged to render the planar surface as referred to above to be a generally continuous surface extending generally the entire length of said sill crown.

In a particularly preferred embodiment, the sill crown is an integral, extruded member including a portion of a generally tubular cross-section, whereby rigidity and dimensional stability of the crown is enhanced.

The invention will now be described by way of a preferred embodiment of the present invention as applied in the art of door sills. The invention will be described with reference to the accompanying drawing wherein.

Figures 1, 2, 3:
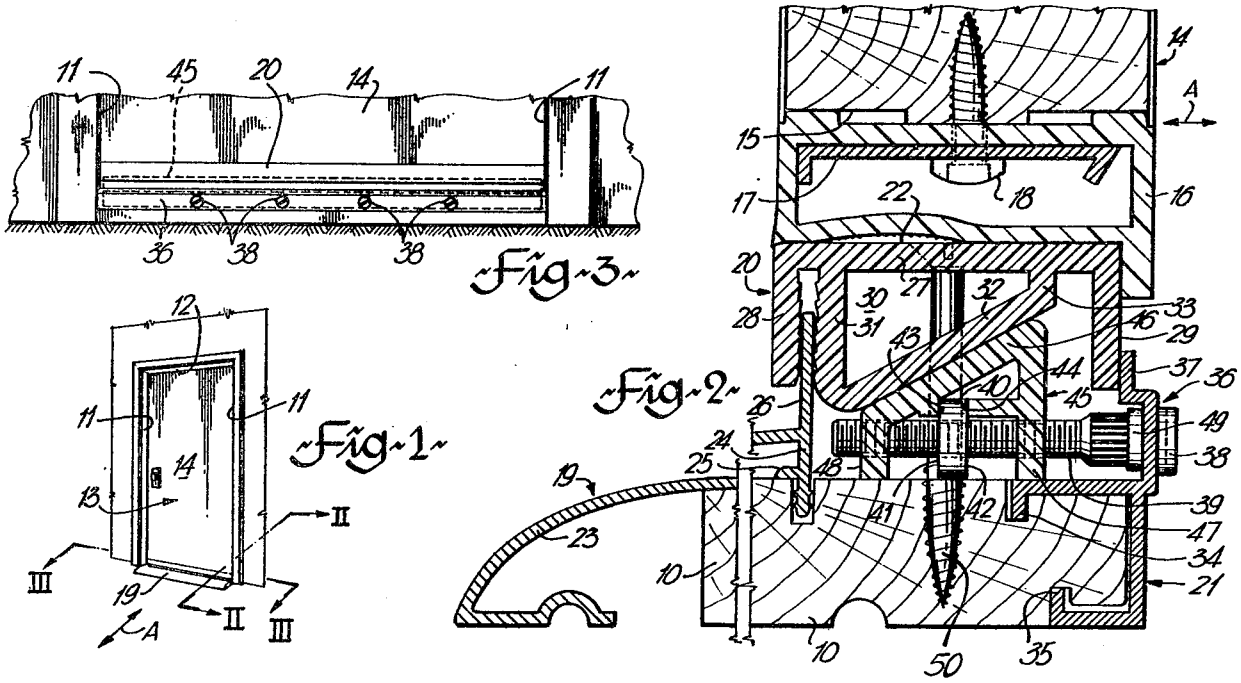
FIG. 1 is a perspective view of a door to which a sill or threshold of the present invention has been applied.
FIG. 2 is section II—II of FIG. 2.
FIG. 3 is a side view III—III of FIG. 2.
Figure 4:
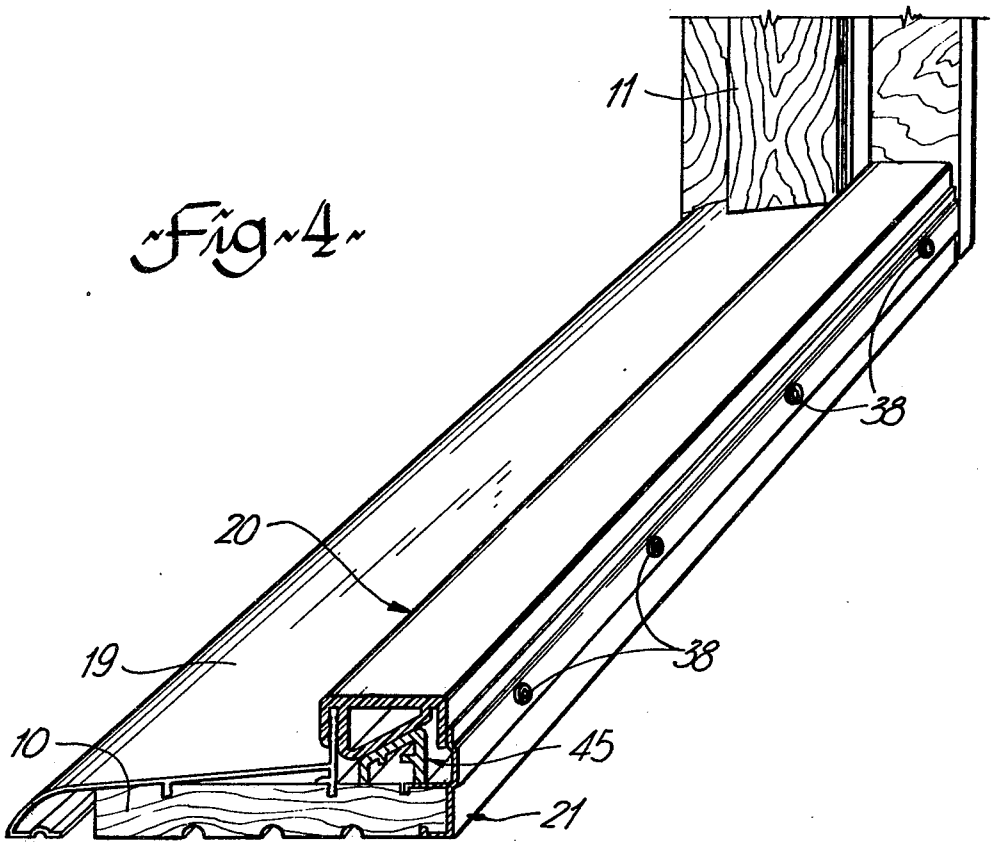
FIG. 4 is a partial perspective view of a door assembly including the present invention.

As best seen from the sectional view of FIG. 2, the sill assembly of the present invention is normally secured to a bottom frame member 10 defining, together with side frame members 11 and a top frame member 12 a door opening 13 into which a door 14 is normally set.

The door 14 has its lower edge 15 provided with a flexible poly-vinyl chloride door sweep 16 normally secured to the edge 15 by an aluminum retainer 17 held in position by a plurality of screws 18, only one of the screws 18 being visible in FIG. 2. On completion of the attachment of the door sweep 16 to door 14, it will be appreciated that the exterior of the door sweep 16 forms in effect the lowermost edge of the door 14 (the door also being referred to generally as "a closure member").

The sill assembly as shown in FIG. 2. comprises generally three surface parts, namely, an exterior sill member 19, a sill crown 20 and an interior sill member 21, the portions 19, 20 and 21 being generally disposed one after the other, in the direction A of passage through the opening. The sectional view of FIG. 2 shows that the top surface 22 of the crown 20 forms a top or uppermost surface portion of the entire sill.

The exterior sill member 19 is an extrusion molded aluminum piece consisting of a top cover section 23 which stretches over a predetermined distance of the exterior top of the bottom frame member 10. The right end of the top cover section 23 as viewed in FIG. 2 merges with a downwardly extending anchor flange 24 provided with a shoulder 25, the anchor flange 24 being generally co-planar with an upwardly extending guide flange 26.

The crown 20 is an extrusion molded rigid polyvinyl chloride piece extending the entire width of the door opening 13, to abut at the respective ends against the respective side frame members 11. FIG. 2 shows that the sill crown 20 comprises an upper, horizontal web 27 whose top surface defines the above mentioned top surface 22. The sides of top web 17 are integral with the respective skirt or flange sections 28, 29. Disposed interiorly of the sill crown 20 and generally between the skirt sections 28, 29 is a central reinforcing section which, as best seen from FIG. 2, is of a generally tubular cross-section. The reinforcing tubular section defines an elongated passage 30. The tubular section is formed by the aforesaid top web 27, by a downwardly depending section 31, by a sloping bottom section 32 and by another, relatively short, vertical section 33, enclosing the passage 30.

The interior sill member 21 comprises anchoring sections 34, 35 for fixedly securing the interior sill member 21 to the interior face of the bottom frame member 10. Extending upwardly from the joinder between anchoring sections 34, 35 is a flange 36 having an inwardly disposed lip 37. The lower portion of flange 36 is provided with four passages generally equidistantly spaced from each other along the interior sill member, each of the passages receiving the head end 38 of an adjustment screw 39, the screw 39 being in engagement with a steel adjustment nut 40. The nut 40 is of a square shape when viewed from each of its axially opposite ends 41, 42. The axially opposite ends 41, 42 are in engagement with the respective shoulders 43 and 44, the shoulders being integral with an extruded rigid poly-vinyl chloride wedge member 45 which further includes a downwardly and forwardly sloping top section 46 and two depending skirts 47, 48 each of the skirts 47, 48 having a passage therein for the adjustment screw 39, as seen in FIG. 2. The wedge member 45 is also referred to as a "first wedge member".

FIG. 3 shows that the length of the wedge member 45 generally corresponds to the length of the sill crown 20, the wedge member 45 being only slightly shorter to allow for adjustment as referred to hereinafter.

When applied to a bottom frame member of the type of a wooden sill of a door, the exterior sill member 19 and the interior sill member 21 are first secured to the bottom frame member 10 of the door opening. Subsequently, the adjustment screws 39 are inserted into the respective openings in the flange 36 and secured into the position against axial displacement by a clip or washer 49, with the adjustment nuts in place. The adjustments nuts 40 of the four adjustment screws 39 are preferably arranged in a co-planar relationship to facilitate subsequent positioning of the first wedge member 45 in a position as shown in FIG. 2. The sill crown 20 is then positioned over the first wedge member 45 with the exterior surface of bottom section 32 of the sill crown 20 engaging the downwardly and outwardly sloping top surface of the top section 46 of the first wedge member 45. It will be appreciated that the engagement of the skirt sections 28, 29 with the guide flange 26 and the lip 37, respectively, provides means for preventing the displacement of the sill crown in either of the directions A of passage of the door opening. Accordingly, on suitable manipulating of the adjustment screws 39, the level of the top surface 22 of crown 20 can be adjusted. When the final adjustment level is achieved, four anchor screws, one of which is shown at 50, are driven vertically throughout the assembly into the bottom frame member 10.

The generally tubular section defining the passage 30 enhances rigidity of the sill crown, while the continuity of the wedge surfaces of bottom section 32 and top section 46 of the respective wedge members provides for a reliable and firm engagement between the two adjusting members.

Those skilled in the art will readily conceive further embodiments differing from the above example. For instance, the adjustment screw 39 could be used in a reversed fashion whereby the load encountered at the sloping sections of the wedge members would subject the respective screws to an axial tension. Another readily conceivable embodiment would split the first wedge member 45 in two portions, each containing two adjustment screws or even a single adjustment screw even though it is believed that a unitary, integral first wedge member 45 as shown is the best solution. These and many other modifications of the design do not depart from the scope of the present invention as set forth in the accompanying claims.

The embodiments of the invention in which an exclusive property or privilege is claimed are defined as follows:

1. A sill assembly forming the external surface of bottom frame of an opening into which a closure member is to be set, said assembly being of the type including an elongated sill crown whose top, generally planar surface defines a top surface portion of the sill, adjustment means for selectively adjusting the level of said top surface portion to bring same into a generally parallel relationship with the bottom edge of an associated closure member; said adjustment means being of the type of wedge means comprising a first wedge member in engagement with a second wedge member along a generally planar surface generally parallel with the elongation of said sill and sloping downwardly and outwardly relative to said opening; said first wedge member being operatively associated with displacement means comprised in said adjustment means for selectively displacing said first wedge member generally in the direction of passage through said opening to adjust the level of said top surface portion of the crown; said second wedge member engaging retainer means for preventing the displacement of said second wedge member in the direction of displacement of said first wedge member; wherein said surface of contact is a generally continuous surface extending generally the entire width of said opening from one end of said sill assembly to the other end thereof, whereby the stability of the adjusted crown is enhanced; said sill crown being an integral, extruded member of a generally tubular cross-section, whereby rigidity of said crown is enhanced; a portion of said tubular cross-section being straight and generally coincident with said generally planar surface, whereby said portion forms said second wedge member.

2. Assembly as claimed in claim 1, wherein each side of said crown further comprises a downwardly extending skirt section engaging guide means; said guide means, in turn, being fixedly secured to a frame member of said opening and slidably engaging the respective skirt section for preventing said crown from generally horizontal displacement in a direction of passage through said opening while allowing a generally vertical displacement of said crown for adjustment of its level, whereby said guide means and said skirt section form said retainer means.

3. Assembly as claimed in claim 2, wherein said first wedge member is an integral, elongated, extrusion molded member, said displacement means including at least two adjustment screws extending generally horizontally and parallel with the passage through said opening, said two adjustment screws engaging said first wedge member at two engagement points horizontally spaced from each other.

4. Assembly as claimed in claim 3, wherein the length of said first wedge member generally corresponds to the width of said opening, whereby said first wedge member is formed by a single, integral member.

5. Assembly as claimed in claim 4 wherein said first wedge member is a generally channel-shaped member including interior shoulder means engaging axially opposite faces of drive nuts associated each with the respective adjustment screw.

6. A sill kit for forming the external surface of bottom frame of an opening into which a closure member is to be set, said kit being of the type including an elongated sill crown whose top surface is arranged to define a top surface portion of the sill; adjustment means for selectively adjusting the level of said top surface portion to bring same into a generally parallel relationship with the bottom edge of an associated closure member; said adjustment means being of the type of wedge means comprising a first wedge member and a second wedge member, said wedge members being adapted to engage each other along a generally planar surface generally parallel with the elongation of said sill crown and, on application, to slope downwardly and outwardly relative to said opening; said adjustment means further comprising displacement means for selectively displacing said first wedge member in a direction of passage through said opening to adjust the level of said top surface portion of the crown; retainer means arranged to prevent displacement of said second wedge member in the direction of displacement of said first wedge member; wherein the surface of said wedge member and of said second wedge member are arranged to render said generally planar surface to be a generally continuous surface extending generally the entire length of said sill crown; said sill crown being an integral, extrusion molded member including a portion of a generally tubular cross-section, whereby rigidity of said crown is enhanced; said portion of a generally tubular cross-section forming said second wedge member.

7. A kit as claimed in claim 6 wherein each side of said crown comprises a skirt section adapted to engage guide means, said guide means being adapted to become fixedly secured to a frame member of said opening and to slidably engage the respective skirt sections, whereby said skirt sections and said guide means are adapted to form said retainer means.

8. A kit as claimed in claim 7, wherein said first wedge member is an integral, elongated, extrusion molded member, said displacement means including at least two adjustment screws arranged to extend generally transversely of said first wedge member, said at least two adjustment screws being arranged to engage said first wedge member at two engagement points spaced from each other longitudinally of said first wedge member.

9. A kit as claimed in claim 8, wherein the length of said first wedge member is only slightly less than the overall length of said crown, said first wedge member being a single, integral member.

10. A kit as claimed in claim 9, wherein said first wedge member is a generally channel-shaped member including interior shoulder means adapted to engage axially opposite faces of a drive nut normally engaged by a respective one of said adjustment screws.

* * * * *